US005813931A

United States Patent [19]

Gormley

[11] Patent Number: 5,813,931

[45] Date of Patent: Sep. 29, 1998

[54] BALL AND TAIL

[75] Inventor: Ian Gavin Gormley, Durban, South Africa

[73] Assignee: European Sports Merchandising BV, Amsterdam, Netherlands

[21] Appl. No.: 896,529

[22] Filed: Jul. 18, 1997

[30] Foreign Application Priority Data

Jul. 19, 1996 [ZA] South Africa ..... 96/6143

[51] Int. Cl.[6] ..... A63B 43/02

[52] U.S. Cl. ..... 473/575; 473/614

[58] Field of Search ..... 473/575, 576, 473/569, 614, 604, 423, 424, 426, 428, 429, 430, 138, 139

[56] References Cited

U.S. PATENT DOCUMENTS

| | | | |
|---|---|---|---|
| 3,368,815 | 2/1968 | Alabastro | 473/575 |
| 3,393,911 | 7/1968 | Lawson | 473/576 |
| 4,088,319 | 5/1978 | Clarke | 473/575 |
| 4,266,781 | 5/1981 | Blue | 473/575 |
| 4,294,447 | 10/1981 | Clark | 473/575 |
| 4,657,319 | 4/1987 | Lerner et al. | 473/576 |
| 4,696,472 | 9/1987 | Meyer | 473/575 |
| 4,826,179 | 5/1989 | Callaghan | 473/576 |

*Primary Examiner*—Steven B. Wong
*Attorney, Agent, or Firm*—Young & Thompson

[57] ABSTRACT

A ball for playing tennis type games in which the ball bounces comprises bouncing ball with a tail; the ball having experimentally determined parameters regarding bounce, diameter, mass, density and air penetration factor; and the tail constituted by one or more, and preferably two or more, lengths of flexible material having experimentally determined parameters of flexibility rating, length, mass, and thickness.

8 Claims, 5 Drawing Sheets

BALL AND TAIL

This invention relates to a ball and tail which has reduced and adjustable flight length, is slowed and spin retarded in flight and roll retarded on the ground, for bat (or racket) and bouncing ball type games similar to Tennis, Squash and Table Tennis.

BACKGROUND OF THE INVENTION

The basis of the present invention is the provision of a specially designed flexible tail arrangement on a bouncing ball incorporating one or more thin lengths of material, the tail having the effect of slowing down the ball in flight, thereby reducing the length of flight, retarding the spin of the ball during flight, and reducing the roll of the ball on the ground. The tail is designed so as not to materially impair strokes at the ball with the bat and not to seriously prejudice the bounce of the ball needed for the bouncing ball type games.

The slowing effect of the tail tends to make the playing of these games easier which is important in making such games popular.

One object of the invention is to provide reduced range balls for bat and bouncing ball games similar to tennis, (although other bouncing bat and ball games may be played) so that games may be played on smaller courts than otherwise possible, while still permitting full shots to be played. In this type of games an important feature is that the ball may be played after it has landed ie. a player may wait for the ball to bounce before hitting the ball.

The reduced roll of the ball also reduces and largely eliminates the need for restraining netting or fencing around the perimeter of the court or playing area.

Pertinent prior art includes toys which have a head and a flexible tail. Many of these are used for throwing games, the projectile being swung around by its tail in the nature of a sling, and then released for another player to catch by the tail and continue the game. These toys are not designed for use with bats in bouncing ball games similar to tennis and they do not therefore anticipate the present invention.

There is no known relevant prior art which makes any reference to balls with tails to be used in bat and bouncing ball games similar to tennis or other bouncing ball games, and no known reference is made to the design parameters required which would make such games practical. In particular, no reference is made to any parameters relating to key requirements such as ball size and weight, the flexibility, weight, surface area and length of the tail, bounce of ball and tail and flight range.

The problem that arises when trying to play games in which the ball may be hit after it bounces, is that a ball spins after striking the ground, having been hit more or less horizontally. This tends to cause any tail attached to the ball to become temporarily wrapped around the ball. As the ball has to be hit quite soon after it bounces, the tail does not always have time to unwrap itself and stream out behind the ball, which is its normal position in flight. Unless the tail is particularly light, strong and flexible, if the tail becomes wrapped around the ball, it can interfere with any shots at the ball, become damaged by the shots at the ball, and can prevent a clear sight of the ball. In addition, the weight of any tail can seriously prejudice the height of the bounce of a ball which also can make it difficult if not totally impractical to use such a ball and tail for bat and bouncing ball games. These problems might well be the reason why there is no reference to ball and tails used for bouncing ball games in the prior art, and the object of this invention is to overcome these problems.

Another feature of this invention is the effect of the tail in reducing the roll of the ball along the ground which rapidly brings the ball and tail to a halt after being hit. This is an important feature, in that it largely eliminates the need for surrounding enclosures as in tennis. This function is not referred to in any prior art with reference to bat and bouncing ball type games.

An example of such prior art is the so-called "FOX TAIL" which is the subject of U.S. Pat. 4,826,179.This consists of a nose portion and a long single conical fabric tail. The tail is segmentalized, and the game is scored with points obtained by catching the tail on a segment having a particular value.

In addition, the "FOX TAIL" as marketed uses a ball weighing approximately 3 ounces (±90 g), which is relatively heavy and dense, and would not be appropriate for racket games of the type as covered by this invention.

Balls in this weight range are not within the scope of this invention, which is concerned with balls of approximately tennis ball weight, or less, ie. 2.1 oz (60 g), or less. The essentials for a successful toy of the FOX TAIL type are different from those required for the present invention. There are no references relating to design parameters which might have made it possible to use the FOX TAIL for bat and bouncing ball type games, and no such games are suggested or advertised for the FOX TAIL.

Another example is U.S. Pat. 4,294,447 (Merlin W. Clark) which comprises a sponge type ball with a streamer secured to the inside of the ball. The streamer can serve as a throwing handle and the toy is described as an aerial amusement projectile. There is no suggestion that the projectile can be used in a game involving striking the ball portion with bats, and there is no indication of any parameters relating to the bounce of the ball and the flight characteristics of the toy which might render it practical to use for bat and bouncing ball type games.

U.S. Pat. 4,266,781 (Walter L. Blue) relates to another toy which has a ball and a tail with a tassel 13. The tail however, takes the form of a rigid rod and the tassel is not stated to have any defined parameters. Thus, although the head 10 (or 15) has bounce the arrangement is designed for a throwing game against a surface and catching it on the rebounce. The rod would interfere with the bat if used in bat and bouncing ball type games.

U.S. Pat. 3,368,815 (P. Z. ALABASTRO) relates to a dome shaped head 14 and streamers 13. The toy is used for a foot propelled game. Head 14 has an aluminium covering and is therefore not suitable for bat and bouncing ball type games. Streamers 13 are not of any particular length and no other design parameters are laid down relating to the bounce of the unit on the ground or to its flight pattern U.S. Pat. 3,393,911 (R. W. LAWSON) is a projectile type toy similar to U.S. Pat. 4.926.179 (the FOX TAIL) which is designed to be held by the tail and thrown. It has a resilient teardrop shaped head 28 which includes a foam rubber pad 20. Thus it is not suitable for a bat and bouncing bail type game as the head of the ball is not spherical and would therefore bounce erratically on contact with the ground. In addition, no definite parameters are given for the tail of the ball, so that the required flight and bounce patterns of the present invention would not be achieved or only by accident U.S. Pat. 4,088,319 (W. A. Clarke) has a single tail of plastic foam with which the ball is thrown or caught, there being no reference to any parameters of design which will permit a practical tennis type game to be played. In addition, the tail is specifically stipulated as having a memory or resilience which causes it to spring back into its original shape when deflected. A tail with such characteristics would interfere with a bat or racket should bat and bouncing ball type games be attempted.

A recent addition to the streamer-type projectile is the POCO (Trade Mark) ball. This comprises a ball with 10 fabric streamers. The toy is used by grasping the streamer tail, twirling and releasing. The tail portion is relatively heavy at 10 g (0.35 oz) in relation to the weight of the ball of 42 g (1.48 oz) and the complete unit has a very low bounce, which makes it completely unsuitable for bat and bouncing ball games. In fact, the projectile is the latest in the long line of throwing projectiles in which the streamers serve as a throwing aid and also as a catching means. It is not designed for a bat and bouncing ball type game.

Another interesting recent innovation is the Spider ball (Trade Mark). This comprises a ball with a number of floppy string like legs fastened all over the surface of the ball, which restrain the roll of the ball on the ground. It is not designed for a bat and bouncing ball type game. The floppy legs are relatively short and being round in cross section the surface area of the legs is relatively low. It would appear that the legs are not designed to significantly reduce the length of flight of the ball, as is the case with the present invention. In addition, the fact that the legs are distributed all over the surface of the ball guarantees that the legs will interfere with a stroke at the ball every time it is hit, even if the ball is not allowed to bounce.

It has now surprisingly been found that 'bouncy' balls fitted with specifically designed light flexible tails may easily be struck with a bat or racket even after the ball bounces on the ground, with the tail producing little significant interference with the bat, or effect on the bounce, while playing bat and ball type games. Even if sections of the tail completely obscure the ball after the bounce, or while serving, before the ball has established its normal flight alignment in front of the tail, shots at the ball are not impeded because the tail is so light and flexible, nor is any damage caused to the tail assembly which is made from materials chosen for their toughness and resilience.

Bat and bouncing ball games such as tennis are normally played with bats or rackets weighing between 150–375 g (5–13 oz), which experience over many years has proved a practical and comfortable weight range to handle for the type of shots called for in tennis type games.

Flowing from this the balls have to be of a weight which the bats or rackets used to hit such balls, can easily accommodate without jarring. Traditional tennis balls have a maximum weight of 58.5 g (2 oz) for the practical reason that balls heavier than this will tend to jar or vibrate unpleasantly when struck with a standard tennis racket.

This invention is therefore primarily concerned with balls having the general playing characteristics of the type used in tennis type games, whether it be the official game of tennis or of lighter, slower tennis type training games. In particular, the balls used in this invention will not be significantly heavier (although they can be lighter) than a tennis ball (58.5 g / 2 oz) or denser than a tennis ball (0.42) and they will not be harder in impact feel. It is however, also intended that smaller, lighter balls with tails be used for bouncing ball games similar to Squash and Table Tennis.

In addition, the A.P.F. rating (Air Penetration Factor —ratio of weight in grams to the frontal area of the ball in square centimeters) is not significantly higher than that of a tennis ball of 0.90. This ratio indicates how far a ball is likely to fly when hit. Other things being equal a ball with a high A.P.F. —higher weight, low frontal area, will fly further than a ball with low weight and high frontal area.

The effect of the addition of a tail to a ball has several effects which have to be taken into account in the design of a ball and tail suitable for bat and bouncing ball games.

The first effect is of reducing the length of the flight of the ball through the air before it hits the ground, which is caused by the extra drag of the tail, particularly at its free end away from the ball, where the end of the tail is free to flap or oscillate. It has been found that the amount of drag is directly proportional to the surface area of the tail. The degree of reduction of flight length may be precisely adjusted by changing various elements of the tail assembly design so as to increase or decrease as desired, the amount of drag as the tail passes through the air.

It has also been found that the amount of drag from a tail having at least a portion of the tail, which includes the trailing end away from the ball, formed into two or more separate strips is significantly higher than that from a single tail of the same material having the same weight, length and surface area.

The use of the tail on a ball in bouncing ball type games, permits heavier balls to be used on smaller courts than before because, even if hit hard, the heavy ball will have less tendency to fly out of court because of its reduced flight range. Typically, a tail assembly fitted to a ball will reduce the maximum flight length of a ball by a factor of approximately 30% and will result in a ball having a maximum flight length of between 10 m and 30 m.

The second effect of a tail is to reduce any spin of the ball in the air. The tail streams out behind the ball in flight and rapidly eliminates any side spin or top spin which might be imparted to the ball at impact by the bat or racket used to strike the ball. This ensures that the ball quickly establishes and maintains a straight and true flight. This characteristic is particularly useful when a tail is attached to certain types of ball which otherwise tend to swerve violently in flight when hit with side or top spin. For example, in particular, balls made from Ethylene Vinyl Acetate Foam suffer from this excessive swerving characteristic.

The third effect of the attachment of a tail to a ball is to reduce the amount of bounce of the ball. However, it has been found that by choosing the correct design of materials for the tail, and using this in combination with a ball which inherently has a high degree of bounce, the amount of reduction of bounce caused by the addition of a tail assembly to the ball need not significantly affect or prejudice the playing of bouncing ball type games.

In particular, the free part of the tail assembly outside the ball has to be of very light weight in relation to the ball, so as to affect the height of bounce as little as possible. The tail must also be extremely flexible so as to follow the changes in the direction of the ball with great ease and the tail of course has to be made from tough resilient material to withstand the stresses of flight and the impact of being struck with a bat.

A fourth effect is that a tail assembly reduces the roll of the ball along the ground after it has landed. This is because the tail assembly inhibits the free roll of the ball. while a typical tail assembly for the reasons reviewed above is very light and flexible and will not bring the ball to an mediate stop, it has been found that the length of roll can be reduced by a factor of at least 75% depending on the tail design.

This feature is especially useful in reducing the need for players to run long distances to retrieve a ball after it has landed and is rolling along the ground and also to reduce or eliminate the need for netting around a court.

A fifth effect is the affect of the surface area of the tail and the resultant drag on the duration and rate of deceleration of the flight of a ball before it lands.

If a ball has a very small tail of low surface area with little drag, it will only need to be struck relatively gently to reach a given spot if such a spot is well within the maximum range of a particular ball and tail.

However, if the same ball is fitted with a tail with much higher surface area and thus much higher drag, it will have to be hit much harder to reach the same spot. It will therefore leave the bat at a much higher speed and its average speed during flight will be much higher than a bat with a low drag tail.

Not only will it be travelling faster, at any point in its flight, but it will also be decelerating quicker. Both these factors will make the ball harder for the opponent to follow with his eyes and to hit.

Thus overall, a very high drag tail will not be appropriate because the relatively high deceleration of the ball and tail results in a flight pattern too disparate for that experienced with balls with no tails, or balls with tails with less severe degrees of drag.

Conversely, if a ball is fitted with a tail and struck with the same force as a ball with no tail, at any point along its flight path, it will be travelling slower than the ball with no tail because of the decelerating effect of the tail. The tail thus slows the flight down, making a ball with a tail much easier to see, to hit, and to run to in order to hit.

A sixth affect relates to the noise, and visual effect, emitted by the tail in flight. It has been discovered that as opposed to a ball with a tail comprising only a single element, the tail of a ball having two or more elements emits a noticeable fluttering noise which, together with the movement or oscillation of the tail, makes the ball and tail in flight more noticeable and "alive". This feature makes it easier to follow the path of the ball and tail in flight and more enjoyable to watch.

Having regard to these various effects of a tail on a ball, the essence of this invention is the discovery that within the relatively narrow limits laid down in this invention, a suitable balance can be achieved between the different conflicting affects of a tail so as to produce a ball fitted with a tail which is excellent for bat and bouncing ball type games.

The major area of conflict is that while an increase in the weight of the tail reduces the length of flight of a ball (because the surface area of the ball and therefore the drag is increased) at the same time the extra weight prejudices the height of the bounce of the ball, which is very sensitive to any increase in the weight of the tail attached to the ball.

It was found that a ball could be fitted with a tail having a high surface area which would permit adequate bounce while, at the same time, offering worthwhile flight reduction. Combined with this was the simultaneous discovery that if the tail was light and flexible enough, even if the tail became completely wrapped around the ball as it especially tends to do after it bounces having been hit horizontally, shots at the ball are not impeded and strokes can be made at the ball with little noticeable effect.

Thus it was discovered that a ball fitted with a tail can be a practical possibility for use in bat and bouncing ball games.

The combined effect of the various influences outlined above on the behaviourof a ball by the addition of a tail is particularly useful for bouncing ball games such as tennis type games. In particular, the reduced flight range permits heavier balls to be used on smaller courts which give more impact satisfaction and are closer in feel to the great game of tennis; it also encourages hard shots, which are most enjoyable, to be played because they are less likely to fly out of court For example, light foam plastic balls have been used as tennis trainers in games such as Mini Tennis. However, as soon as the weight of these balls exceeds approximately 30 g (1 oz), the maximum range of the ball goes beyond 30 m (97'), and players find it much harder to play flat out shots without the risk of the ball flying out of court, even on a full sized tennis court which has a length of 24 m (78'). When balls tend to fly out of court if hit hard, the game tends to become a gentle, softly struck game, which is not enjoyable to play or watch.

The reduced flight range and reduced roll of the ball also largely eliminates the need for constraining screens or structures which has always been a major practical problem when playing bouncing ball games, particularly outdoors.

Outdoor games are susceptible to wind and are more practical with the heavier balls which this invention permits because of the reduced effect of wind on their flight. Games played with light foam balls are very susceptible to the wind.

It should also be noted that the addition of a tail to a bouncing ball when used for bouncing ball type games makes the ball attractive to watch, and easier to see and to track through the air, both for the player and the spectators.

The ability for a game to be played in which the ball may be hit after the bounce makes it considerably easier for players and greatly increases the appeal of the game, compared with "no bounce" volley type games such as badminton, because a player is given a first chance to strike the ball while it is still in the air and if he misses or does not reach the ball, he still has a chance to hit he ball after it has landed.

Ball and tail combinations may be varied to suit players of different abilities and the space available for games. Light, short range, high bounce ball and tails may be used by players of limited ability in small areas while better players may prefer to play with a heavier ball and tail with lower bounce and longer flight on bigger courts.

It should perhaps be noted that in the game of badminton the skirt attached to the head of the shuttlecock also acts as a flight and spin retarding device for the head of the shuttle during flight similar in function, if not in form, to this patent application. However, the skirt is a rigid device and even if the rules of badminton allowed the shuttlecock to be struck after the bounce (which they do not) this would not be practical because the rigid form of the skirt would severely interfere with blows at the head of the shuttle, should the shuttle not have completely re-established its normal flight alignment after the bounce. These blows would also damage the skirt, which is not designed to be hit.

In this invention there is no such problem because the light flexible tail assembly does not materially impede shots at the ball even if part of the tail assembly should completely obscure the ball. The tail is also designed to resist damage when hit. There is therefore no similarity with shuttlecocks of the badminton type. It might be of interest that this invention arose directly as a result of experiments with balls and streamer tails to replace the traditional shuttlecock used in badminton type games. It so happened that the combination of ball and tail being used for the tests happened to have a good bounce. It was completely fortuitous that some children not involved in the experiments started playing tennis type bouncing bat and ball games with some spare ball and tail units, and it was realised that a ball with a tail could be used for such games.

THE INVENTION

According to the invention a combination ball and tail is provided, characterized in that the ball has a minimum bounce height when fitted with its tail of at least about 50 cm (19.7 inches) when dropped 254 cm (100") upon a smooth flat horizontal concrete base and a minimum bounce of at least 80 cm (31.5") without its tail.

a diameter of between 25–100 mm (1 to 4 inches), a mass of between about 2 g and 75g (0.3 to 2.6 oz), a relative density no greater than about 0.5, an Air Penetration Factor no greater than 1.0, (ratio of weight in grams to the frontal area of the ball in square centimeters)

and the tail has one or more lengths of flexible material attached to the ball, the length/s of the flexible material having :

flexibility rating of between 20 mm (0.8") and 100 mm (4") (ie. the distance in millimeters that a parallel strip of material may be pushed out horizontally at right angles into space over a straight edge before the leading edge of the strip subtends an angle of 45 ° to the straight edge from the horizontal), a minimum length of not less than three times the diameter of the ball and maximum length of 1.2 m (47"), a weight of the tail outside the ball of not more than 20% of the ball (including any anchor fittings or part of the tail outside the ball) without the outside part of the tail attached, a thickness of material of less than 0.1 mm (0.04").

The tail is preferably attached at a single anchor zone of the ball (preferably no larger than approximately 4 cm sq. ) (0.62 sq. in.) and may consist of one or more light flexible lengths of material, the specification and design of which is chosen for predetermined flight limits, spin of the ball in the air, roll of the ball on the ground, as well as requirements for minimum interference with the bounce of the ball, or strokes with a bat at the ball. If a single length of material is used it is preferred to form at least the trailing end of the tail away from the ball into separate strips, The tail is also preferably designed to provide both aural and visual signals which are both aesthetically pleasing and which also serve to considerably assist the players and spectators in locating the position and tracking the movement of the ball and tail These aural. and visual signals may be provided by ensuring that the design of the tail allows the tail to rapidly oscillate during flights while moving through the air, particularly at its free end, so as to emit a significant fluttering noise and the movement thereof providing a visual signal easily detectable by the human eye. The effect of these signals is significantly enhanced when multiple lengths of material are used in the tail assembly.

It has also been found that these signs are enhanced when the lengths of material making up the tail have a high surface area in relation to their weights (ie. they are very thin, of the order of approximately 0.04 mm –0.0016") and constructed from materials which are relatively hard, and have a high flexibility rating. It has been found that tails made from materials which are. thicker than 0.075 mm (0.003") show relatively slow oscillation in flight.

Tail assemblies which do not oscillate much in flight, and emit no 'fluttering' noise appear relatively lifeless in flight and for reasons not fully understood, are less attractive to play and to watch. Factors which are taken into account in the specification and design of the tail include length, the number of tails, flexibility, density, mass, surface area, texture, material composition, cross sectional and longitudinal design.

While the preferred flight limit is between 10 m and 20 m before the ball lands, the design of the tail and/or the weight of the ball may be adjusted by changing the tail assembly and adding or removing ballast as desired, to increase or decrease the maximum flight of any given ball as required, if necessary, beyond these limits For example, a light ball used by children can have a tail with little air resistance so they will have little difficulty in hitting the ball far enough to utilize all the space available on any given court. On the other hand, adults may prefer a heavier ball which would tend to fly much further than is appropriate for any given court unless a larger tail, with greater drag, is fitted. The ball may therefore be fitted with a ballast weight (or weights) for extra weight and with a tail with more air resistance which reduces its flight length to a distance more appropriate for any given court size.

In addition to the flight length, the degree of roll of the ball on the ground and the degree to which it spins in flight can be controlled independently from the flight length which is dictated by the amount of air resistance to the air flow offered by the tail. If little air resistance is required, a shorter tail can be provided that sits in the slipstream of the ball in flight, protected from full exposure from the airflow. Such a tail design will however, still control and limit the amount or degree of spin while in flight, or of roll along the ground after the ball has landed, which is an important feature of this invention.

It will be appreciated that this invention affords great flexibility in adjusting the performance of a ball. In particular, it enables a ball of an optimum size of say ±70 mm (2.7") to be chosen, which is a size easily visible and is also convenient to handle and catch by the human hand. This size also has a diameter large enough to offer little risk of eye injury. Having chosen this optimum size the weight and/or flight length may be adjusted to suit any court size or level of skill of the player. Preferred balls for use in the present invention include foam plastic balls made from polyurethane, or ethythene vinyl acetate, or hollow balls such as tennis balls, or plain rubber balls.

It should be reiterated that certain of the characteristics required for a practical ball and tail, for use in reduced flat bouncing ball games, have to be closely specified in order for the performance of the ball and tail to be practical for such games. In particular, the surface area of the tail (which is directly related to the weight of the tail) in relation to the weight of the ball, directly affects the degree of flight length reduction —the higher the surface area of the tail in relation to the weight of any given ball, the greater the flight length reduction.

On the other hand, the surface area of the tail is directly related to the weight of the tail assembly and the higher the weight of the tail, the greater the prejudice to the height of the bounce. Careful research has been carried out and the conflicting effects of bounce and flight length loss have been plotted on the graph shown at FIG. 8.

This graph shows the conflicting effects of tails of different weights on the bounce and flight length loss on a 60 mm (2.4") diameter foam polyurethane ball. The relative weights of the ball to the tail is shown on the bottom axis as the Ball/Tail ratio. The shape of the graph is similar to and typical of the performance balls of other types and weights with different tails.

It will be seen from this graph that the ball and tail has to be carefully designed to ensure that while a worthwhile reduction in flight length is achieved, this does not at the same time seriously prejudice the height of the bounce.

Theoretically extremely light flimsy tails, made from very thin material, would have high drag to reduce the flight length of the ball but would have little weight to inhibit the bounce of the ball. However, in practical terms, it has been discovered that one cannot use material thinner than 20 microns (0.02 mm –0.0008") as below this level the material becomes too flimsy and liable to breakage. It is necessary therefore to use material which is at least 2 microns thick at which thickness the weight of the tail starts to become significant in relation to a surface area.

In order to achieve a fair balance between the two conflicting requirements of flight length reduction without prejudicing loss of bounce height, it has been found that the weight of the ball, compared with the weight of the tail outside of the ball, should be at least 5 times the weight of the tail, so as to make it possible for the bounce of the ball with its tail to be at least 35% of the bounce of a ball without its tail.

This weight specification which permits a substantial degree of bounce, is also subject to the practical requirement of a minimum absolute bounce of at least 50 cm (19.7"), dropped from a height of 254 cm (100") onto a smooth flat horizontal concrete base.

If a ball and tail is not able to bounce at least 50 cm in this way, it will not be suitable for the games envisaged in this application. In this respect it should be noted as a comparison, that in the game of tennis the tennis ball is required, in terms of the rules, to bounce 135 cm (53").

On the other hand, while complying with this weight specification which permits a reasonable degree of bounce, it has been found that a light tail can be constructed which has sufficient surface area to produce a reasonable reduction in flight length of between 20% and 40%, and which will also substantially reduce the roll of the ball on the ground once it has landed.

BREIF DESCRTION OF GRAPH

Figure 8:
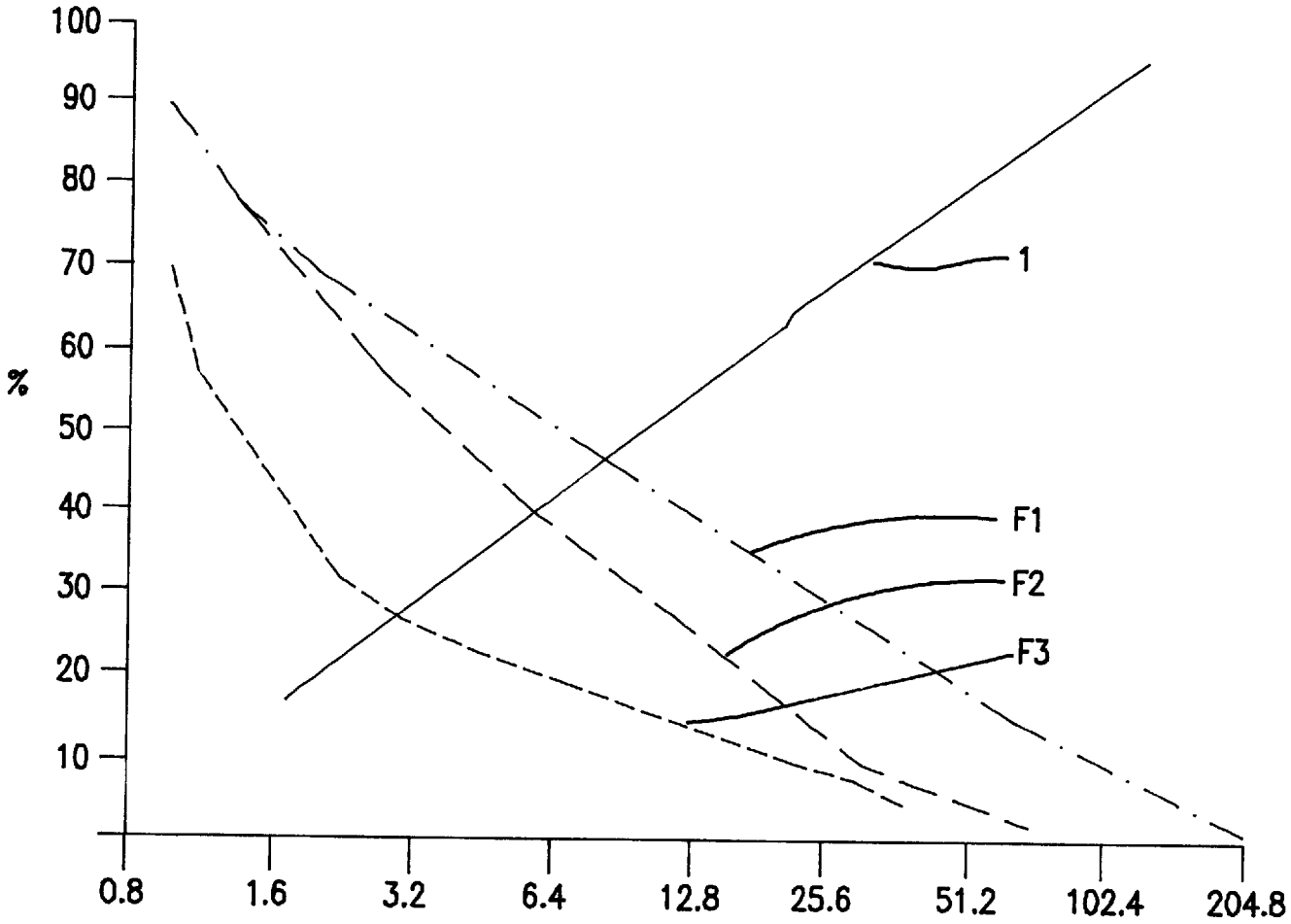

FIG. 8: Graph plotting Bounce and Flight loss of 60 mm (2.4") foam polyurethane ball, weight 13.9 g (0.49 oz).

DETAILED DESCRIPTION OF THE PREFERRED EMBODIMENTS OF THE INVENTION

Figure 1:
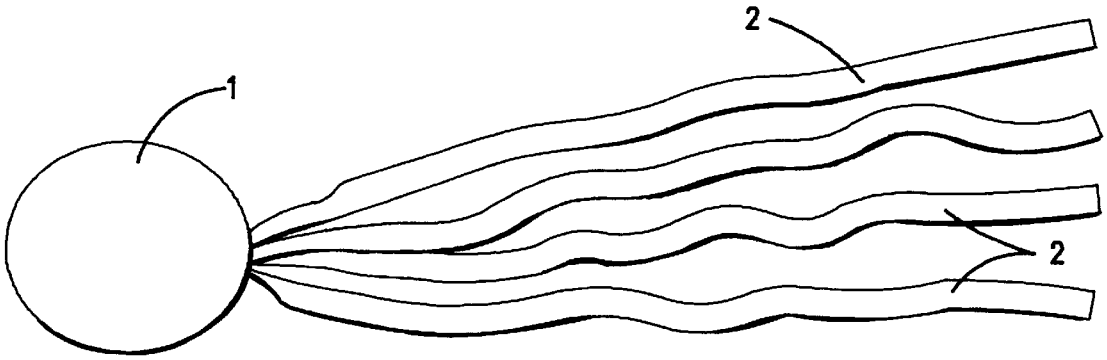
FIG. 1: is a general view of a ball fitted with its tail assembly.

Referring to the drawings:

FIG. 1: The main components are shown, which include a ball 1 together with the tail assembly 2.

Figure 2:
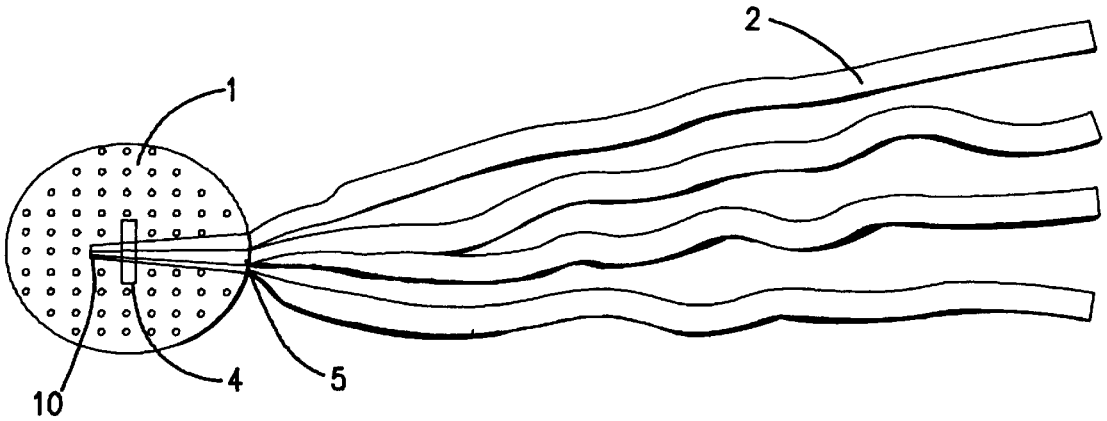
FIG. 2: is a cross-section view of a foam plastic ball showing the arrangement of the anchor plug, tail assembly and ball.

FIG. 2: A cross-sectional view is shown of a foam plastic ball, showing the ball 1, and the tail assembly 2. The tail is attached to a soft anchor fitting 4, consisting of a strip of ethylene vinyl acetate foam, which serves to locate and attach the end of the tail assembly inside the ball. The inner end of the tail is gathered in a knot 10. The anchor point 5 indicates where the tail assembly joins the surface of the ball.

FIG. 3: Show cross-sections of two hollow balls together with their tail assemblies.

Figure 3A:
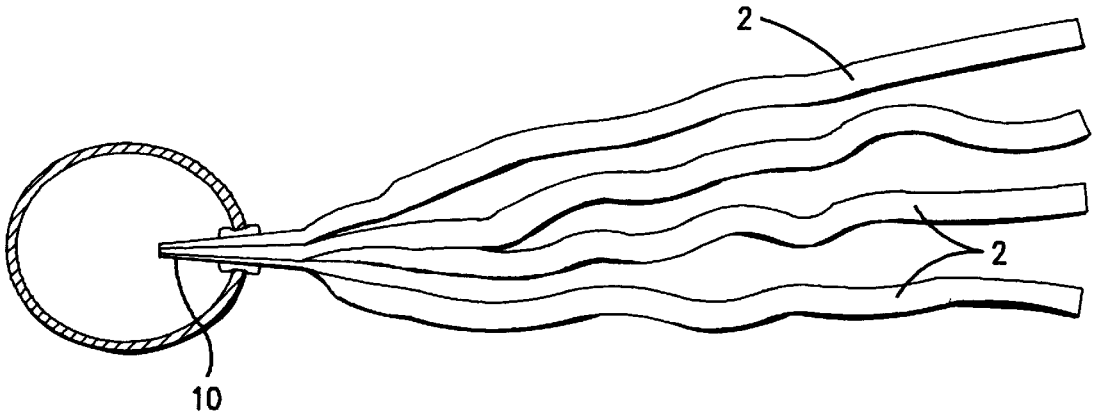
FIG. 3: shows two cross-section views of hollow balls and tail assemblies.

FIG. 3*a:* One ball has been pierced and an anchor plug 6 is fitted in to the resulting aperture. This ball will not be able to retain any internal pressure.

Figure 3B:
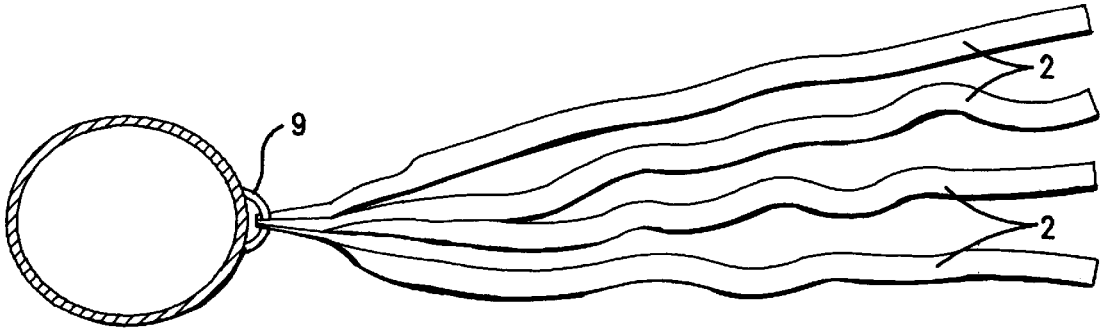

FIG. 3*b:* An unpierced ball is also shown with an external attachment plug 9 so that the ball can be internally pressurized.

Figure 4:
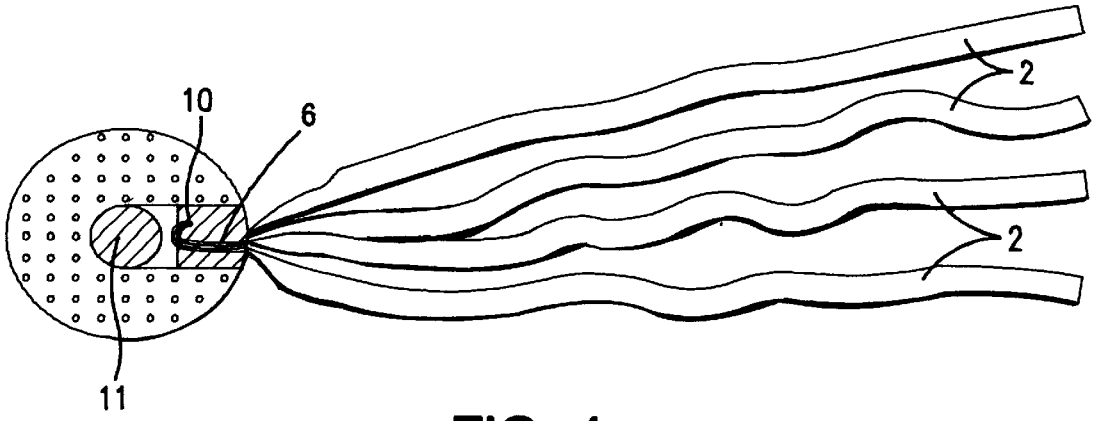
FIG. 4: shows details of a foam plastic ball incorporating a ballast core.

FIG. 4 Shows the cross-section of a foam plastic ball in to the centre of which has been added a dense ballast core 11.

Figure 5:
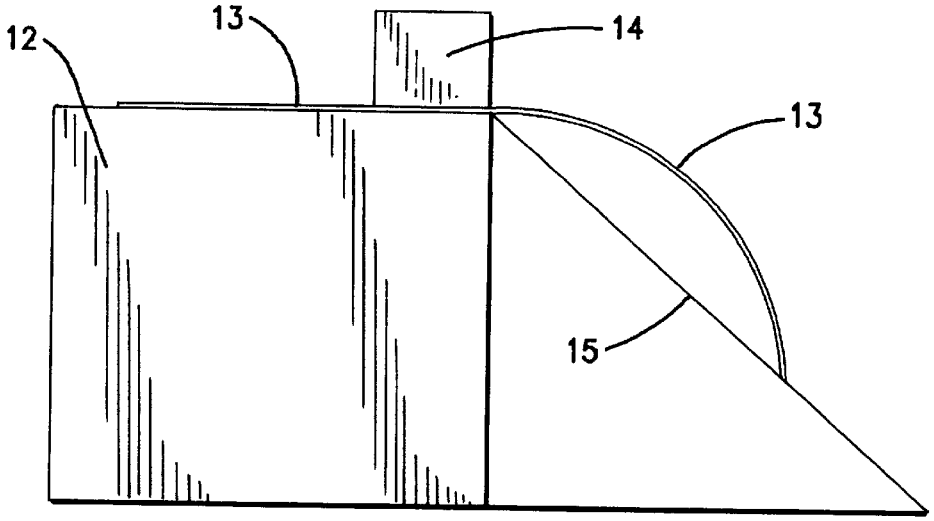
FIG. 5: is a drawing of apparatus for measuring tail flexibility —third angle view.

FIG. 5: Deals with apparatus for measuring tail flexibility. This comprises a third angle view.

Figure 6:
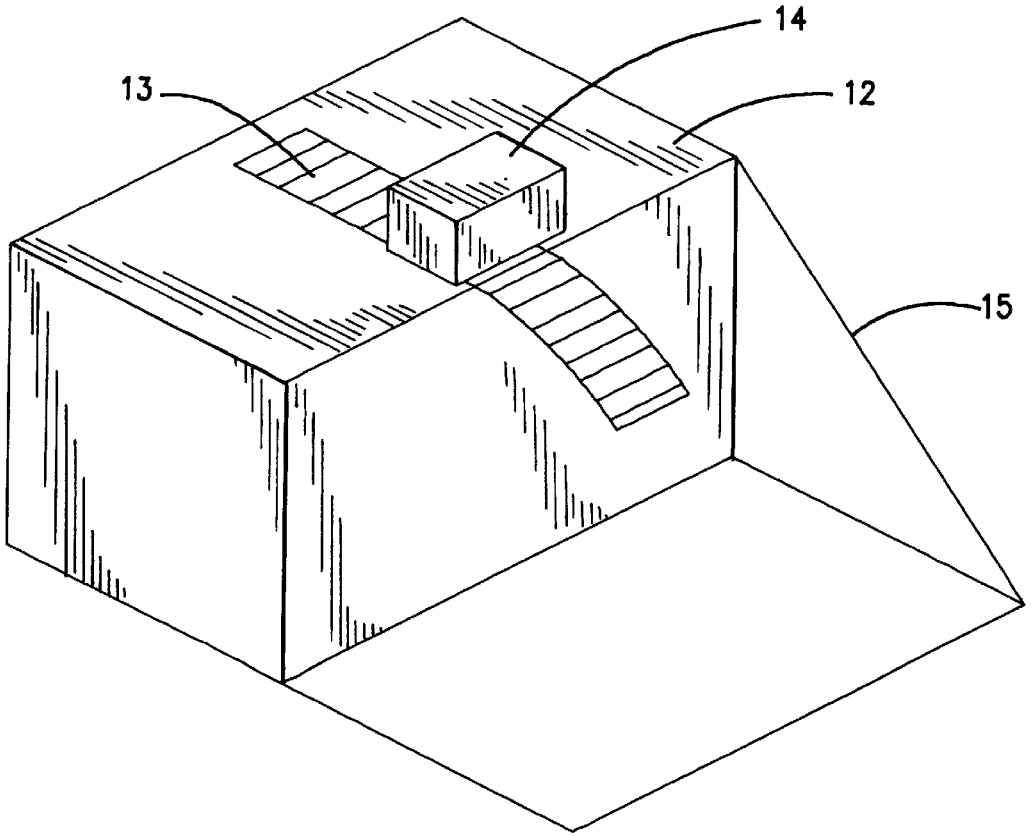
FIG. 6: Apparatus for measuring tail flexibility —side view. Apparatus comprises a surface 12 which receives the sample 13 and the block 14. A distance scale as provided at a 45 ° slope 15.

FIG. 6: Deals with apparatus for measuring tail flexibility and shows a side view.

Figure 7:
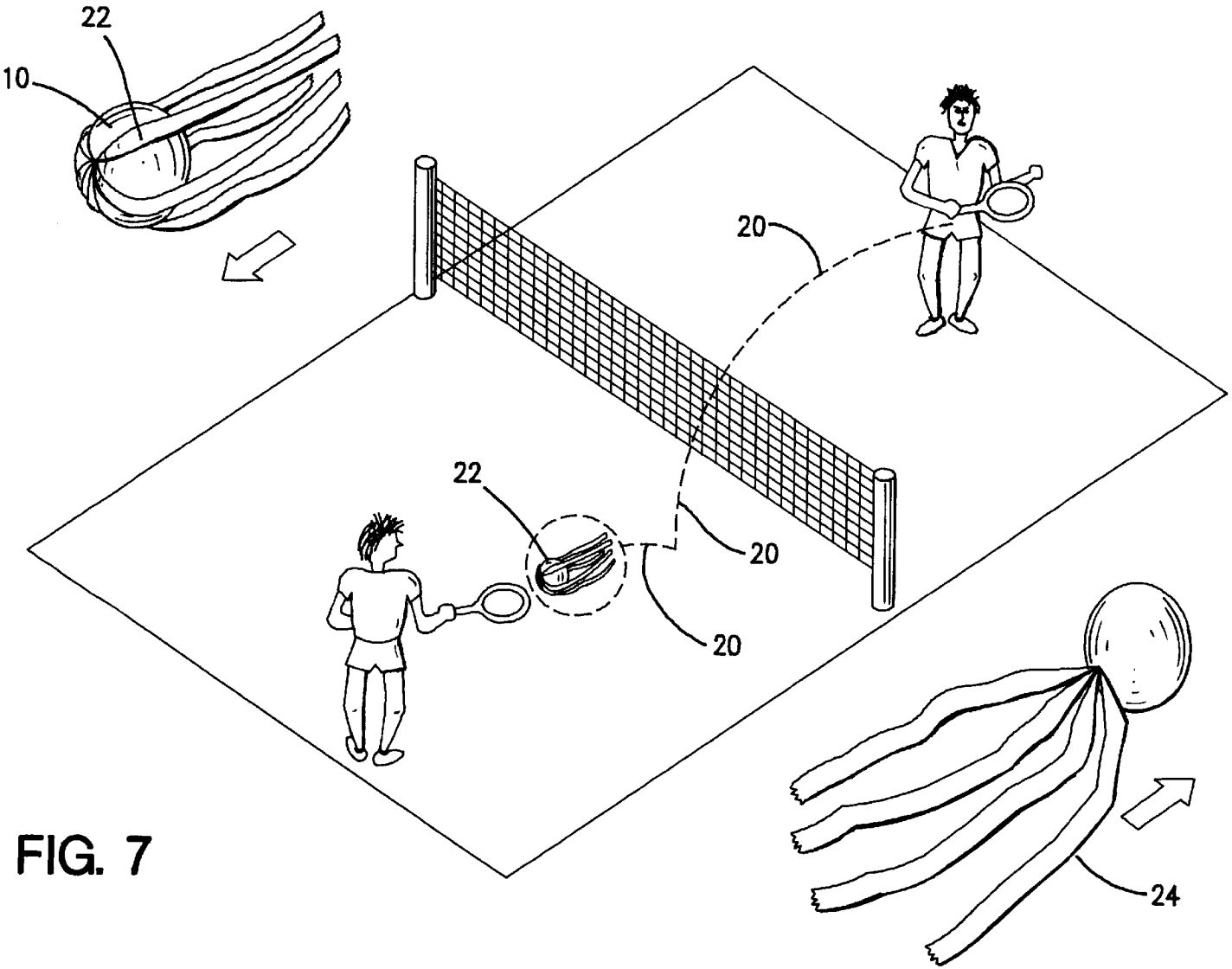
FIG. 7: General view of bat and bouncing ball type game being played with ball and tail, together with view of ball and tail in normal flight

FIG. 7: Shows a general view of a typical bat and bouncing ball type game being played. The flight lines 20, make it clear that the ball has bounced on the surface of the court. Also shown at 22, is the way the tail attached to the ball has become partially wrapped around the ball after the bounce/ 24, shows the ball in normal flight with the tails streaming out behind the ball.

FIG. 8: Graph: The graph plots the bounce loss and flight loss of a 60 mm foam polyurethane ball, weight 13.9 g (0.49 oz) when tested with multiple tails of different weights and different material: This graph is typical of graphs of balls and tails of other weights and materials which reflect similar shapes when plotted. The vertical axis shows percentages from 0 to 100 and the longitudinal axis shows ascending ratios of ball weight to tail weight. The tail weight is the weight of the tail outside the ball, and the ball weight includes any part of the tail and any anchor fittings inside the ball.

The horizontal Ball/Tail ratio line is plotted on a logarithmic scale, so that each unit of length reflects a doubling of the Ball/Tail ratio.

With regard to the "Bounce" Graph marked 1., this shows the percentage of the height of bounce of the ball, fitted with tails of different weights and materials. The ball is released from a height of 254 cm (100") onto a smooth, flat, horizontal concrete base, which is the same test as that used for tennis balls.

The percentage bounce for any given Ball/Tail ratio is the percentage of the height of the bounce for any given ball and tail combination of the height of the bounce of the ball without a tail. The bounce results are the same regardless of the type of material used for the tail, and directly reflect the weight of the tail. This is because in this test, the drag of the tail in flight does not appreciably affect the test while the ball is falling or rising after the bounce, the weight of the tail being the key factor in limiting the height of the bounce.

With regard to the "Flight Loss" Graphs, these plot the length of flight lost as a percentage of the maximum flight of a ball with no tail The test is carried out by hitting the ball hard with a bat at any upwards angle of approximately 45 ° on a flat open area with no wind.

Graph Fl shows the flight loss curve when the tail is made from strips of plastic 0.035 mm thick (0.0014"). This material has relatively high surface area −1 g =365 $cm^2$, and therefore has the highest drag for any given weight of tail. This is reflected by the fact that for any given Ball/Tail ratio, this material has the highest flight loss percentage.

Graph F2 shows the flight loss curve when the tail is made from thicker plastic 0.15 mm thick (0.0059") having a weight to surface area of 1 g =86 $cm^2$.

Graph F3 shows the flight loss curve when the tail is made from 2.5 mm diameter nylon cord which has the lowest possible surface area for any given weight of tail −1 g =±l0 $cm^2$ It will be seen that in the centre area of the graph, where Ball/Tail ratios are between approximately 3 and 20 and is the probable ratio range in which balls and tails will be actually constructed, there is a large difference between the height of bounce percentage at any given Ball/Tail ratio.

As a high bounce is essential for the use of ball and tail units in the play of bat and bouncing ball games, it is necessary that tail material be used with the maximum high ratio of surface area to weight. Only fairly recently have new tough grades of plastic become available which can be extruded into thin films from which a tail can be made which is thin enough to give the high surface area per gram needed for high drag and low weight, while at the same time being tough and strong enough to withstand the stresses imposed during the play of bat and bouncing ball games.

I claim:

1. A combination ball and tail characterized in that the ball has a minimum bounce height, when fitted with its tail, of at least about 50 cm (19.7 inches) when dropped 254 cm (100 inches) upon a smooth flat horizontal concrete base, and a minimum bounce height, without its tail, of at least 80 cm (31.5"), a diameter of between 20–100 mm (1 to 4"), a mass of between about 2 g and 75 g(0.3 to 2.6 oz), a relative density no greater than about 0.5, an Air Penetration Factor no greater than 1.0, (ratio of weight in grams to the frontal area of the ball in square centimeters), and the tail has one or more lengths of flexible material attached to the ball, a flexibility rating of between 20 mm (0.8") and 100 mm (3.9")

a minimum length of not less than three times the diameter of the ball and a maximum length of 1.2 m (47"), the weight of the tail outside the ball is not more than 20% of the weight of the ball without the outside part of the tail attached, a thickness of material of less than 0.1 mm (0.004").

2. The combination ball and tail according to Claim 1, in which the ball and tail has a tail which rapidly oscillates during flight and emits a fluttering noise.

3. The combination of ball and tail according to claim 1, having a maximum flight range of between 10 m (11 yards) and 30 m (33 yards) before striking the ground after being hit.

4. The combination ball and tail according to claim 1, where the material comprising the tail is substantially flat in cross section.

5. The combination ball and tail according to claim 4, in which the material comprising the tail is no thicker than 0.06 mm (0.0024"), the ball has a diameter between 60 mm–90 mm (2.4"to 3.5"), and a mass between 10 g (0.36 oz) and 60 g (2.1 oz).

6. The combination ball and tail in claim 1, in which the ball and tail has bounce of at least 50% of the bounce of a ball without its tail, when dropped from 254 cm (100") onto a smooth flat, horizontal concrete base, and a flight loss of more than 20%, but less than 40%. compared with the flight of the ball without the tail when struck a full blow with a racket at an upwards angle of approximately 45°.

7. The combination ball and tail in claim 6, in which the flight loss of the ball and tail is at least 30%.

8. The combination ball and tail according to claim 1. in which the flexibility rating of the tail is between 20 mm and 70 mm.

* * * * *